US011454160B2

(12) United States Patent
Englert et al.

(10) Patent No.: US 11,454,160 B2
(45) Date of Patent: Sep. 27, 2022

(54) METHOD FOR FILLING A COOLING CIRCUIT OF A MOTOR VEHICLE WITH A COOLANT

(71) Applicant: Mahle International GmbH, Stuttgart (DE)

(72) Inventors: Peter Englert, Bad Friedrichshall (DE); Lukas Hinderer, Altdorf (DE); Lars Kaminski, Ostfildern (DE); Oliver Mamber, Sersheim (DE); Nic Sautter, Plochingen (DE)

(73) Assignee: Mahle International GmbH

( * ) Notice: Subject to any disclaimer, the term of this patent is extended or adjusted under 35 U.S.C. 154(b) by 32 days.

(21) Appl. No.: 17/177,197

(22) Filed: Feb. 16, 2021

(65) Prior Publication Data

US 2021/0254542 A1 Aug. 19, 2021

(30) Foreign Application Priority Data

Feb. 17, 2020 (DE) ..... 10 2020 201 925.8

(51) Int. Cl.
*F01P 11/06* (2006.01)
*F01P 11/02* (2006.01)

(52) U.S. Cl.
CPC ..... *F01P 11/0204* (2013.01); *F01P 11/0276* (2013.01); *F01P 11/06* (2013.01); *F01P 2011/063* (2013.01)

(58) Field of Classification Search
CPC .. F01P 11/06; F01P 2011/065; F01P 11/0204; F01P 11/02; F01P 11/0276
See application file for complete search history.

(56) References Cited

U.S. PATENT DOCUMENTS 5,571,420 A 11/1996 Creeron et al.
8,102,643 B2 * 1/2012 Dittmer ..... H05K 7/20272 361/677
8,685,257 B2 * 4/2014 Beringer ..... C22F 1/10 210/764
9,660,277 B2 * 5/2017 Yang ..... C23F 11/124
(Continued)

FOREIGN PATENT DOCUMENTS

DE 10 2017 206 940 A1 10/2018
DE 10 2018 216 837 A1 10/2019

OTHER PUBLICATIONS

English abstract for DE-10 2018 216 837.

*Primary Examiner* — Long T Tran
(74) *Attorney, Agent, or Firm* — Fishman Stewart PLLC

(57) ABSTRACT

A method for filling a cooling circuit of a motor vehicle with a coolant may include filling the cooling circuit with ion-free water in a water filling operation, leaving the ion-free water in the cooling circuit for a water duration of action in a water operation of action, displacing the ion-free water out of the cooling circuit via filling the cooling circuit with a passivating agent in a passivating operation, rinsing the cooling circuit with ion-free water such that the ion-free water at least dilutes the passivating agent in the cooling circuit and a liquid including at least one of the ion-free water and the passivating agent remains in the cooling circuit in a rinsing operation, displacing the liquid out of the cooling circuit via filling the cooling circuit with the coolant in a coolant filling operation, and/or fluidically sealing the cooling circuit towards an outside in a sealing operation.

20 Claims, 1 Drawing Sheet

(56) References Cited

U.S. PATENT DOCUMENTS

Figure 1:
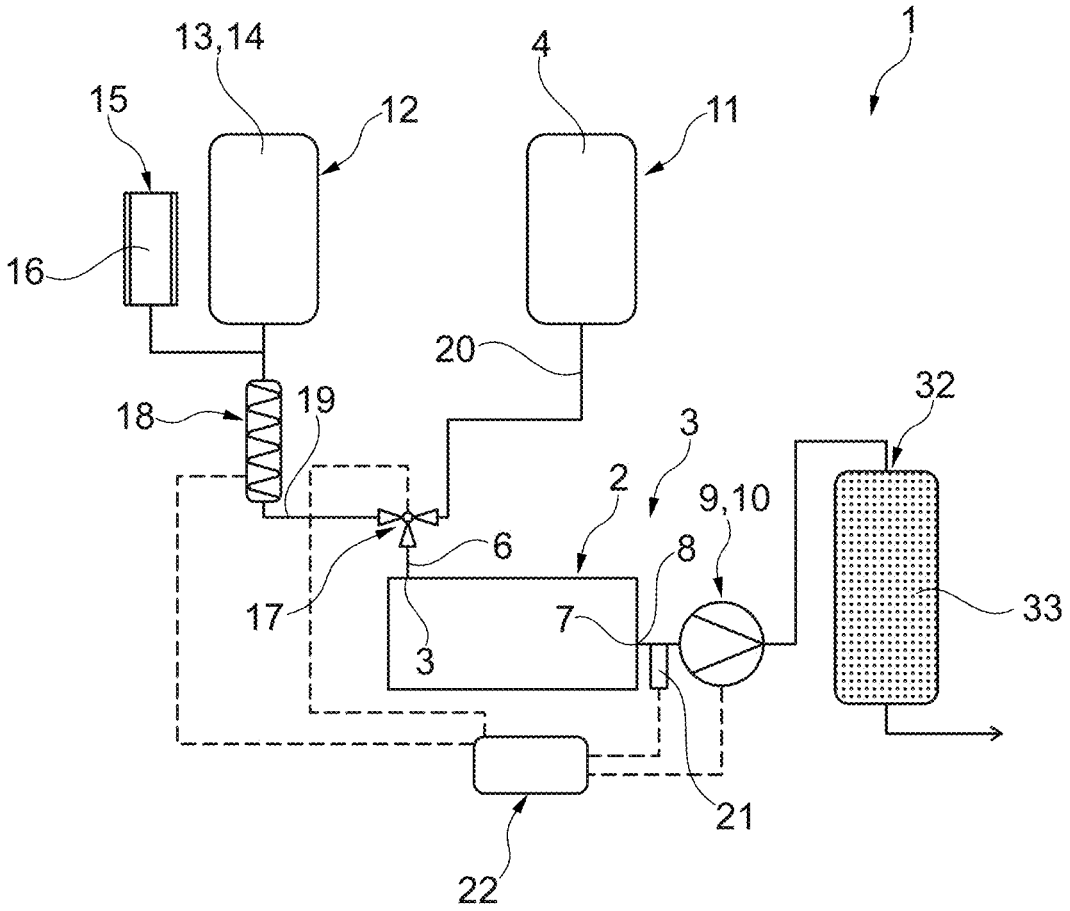

| | | | | |
|---|---|---|---|---|
| 2005/0077252 | A1 | 4/2005 | Shih et al. | |
| 2007/0221163 | A1* | 9/2007 | Kamio | F02M 31/16 123/295 |
| 2011/0000505 | A1 | 1/2011 | Yang et al. | |
| 2018/0305820 | A1 | 10/2018 | Englert et al. | |
| 2020/0316519 | A1* | 10/2020 | Pess | C02F 9/00 |

* cited by examiner

METHOD FOR FILLING A COOLING CIRCUIT OF A MOTOR VEHICLE WITH A COOLANT

The present invention relates to a method for filling a cooling circuit of a motor vehicle with a coolant. The invention, furthermore, relates to a system for filling a cooling circuit of a motor vehicle with a coolant.

In a motor vehicle, a cooling circuit flowed through by a coolant is employed for temperature-controlling, in particular for cooling, components of the motor vehicle. In motor vehicles that are at least partly operated electrically the cooling circuit can serve for example for the purpose of temperature-controlling, i.e. in particular for cooling and/or heating an electric energy store of the motor vehicle and/or an electric drive device of the motor vehicle through a heat-transferring connection. In the process, the cooling circuit as such and in particular the coolant have to fulfil certain peripheral conditions in order to guarantee, in particular not to jeopardise the operation of the components and thus of the entire vehicle. In motor vehicles that are at least partly operated electrically, in which electrical components are temperature-controlled with the cooling circuit, it is important for example that the coolant does not exceed specified electric conductivities. This is the case for example when an electric energy store, such as for example an accumulator of the motor vehicle is temperature-controlled with the cooling circuit. In particular in motor vehicles which have a fuel cell, the electric conductivities of the coolant are particularly significant since the cooling circuit and in particular the coolant, in fuel cells, can be in contact with electric current-conducting components such as for example electrodes and/or bipolar plates in order to temperature-control these.

Even when the coolant as such has an electric conductivity when filled into the cooling circuit which is in a safe range, i.e. does not exceed a specified value, an increase of the electric conductivity of the coolant can occur during the operation of the cooling circuit through interactions of the coolant with components of the cooling circuit. For example the detaching of metallic parts from coolant-conducting components of the cooling circuit, for example from tubular bodies, pumps, valves and the like can be mentioned as cause of this. In addition to this, the said components of the cooling circuit can give off salt-containing and/or ion-containing constituents into the coolant, which can likewise lead to an increase of the electric conductivity of the cooling circuit. An increase of the electric conductivity of the coolant during the operation can lead to undesirable amounts of electricity in the cooling circuit which can be distributed throughout the cooling circuit. This can lead in particular to short circuits and electric arc-overs. When in the electrical components of the motor vehicle high electric currents and/or voltages are present, a detonating gas formation can, furthermore, develop through electrolysis which constitutes corresponding dangers.

In order to reduce an increase of the electric conductivity of a cooling medium in a cooling circuit during the operation of the cooling circuit it is known from DE 10 2017 206 940 A1, to passivate individual coolant-conducting components of the cooling circuit, which are produced on a light metal basis, on their surfaces that are in contact with the coolant during the operation, prior to manufacturing the cooling circuit.

The present invention deals with the object of stating, for a method for filling a cooling circuit of a motor vehicle with a coolant and for a system for filling such a cooling circuit with a coolant, improved or at least other embodiments which are characterized in particular by a simple filling of the cooling circuit with coolant and/or an increased operational safety.

According to the invention, this object is solved through the subject of the independent claims. Advantageous embodiments are subject of the dependent claims.

For filling a cooling circuit of a motor vehicle the present invention is based on the general idea of subjecting the entire cooling circuit prior to the filling with the coolant to a treatment, which prevents or at least reduces the increase of the electric conductivity of the coolant during the operation of the cooling circuit. Thus, individual components of the cooling circuit are not treated separately but the cooling circuit is initially assembled and subsequently treated in its entirety. This has the consequence that all components of the cooling circuit through the treatment do not have any or at least reduced effects on increasing the electric conductivity of the coolant during the operation. In addition it is thus possible to introduce the coolant into the cooling circuit directly after the treatment so that reductions of the effect of the treatment through interactions of the components of the cooling circuits that are in contact with the coolant during the operation with the surroundings, for example with air, are prevented or at least reduced. This leads to a simple and efficient treatment as well as filling of the cooling circuit. In addition, the operational safety of the cooling circuit and of the associated motor vehicle is increased in this way by preventing or at least reducing the increase of the electric conductivity of the coolant during the operation.

According to the inventive idea, the cooling circuit, in a corresponding method, is initially filled with ion-free water in an operation which in the following is also referred to as water filling operation. Following the filling of the cooling circuit with the ion-free water, the ion-free water is left in the cooling circuit for acting for a duration of action, in the following also referred to as water duration of action, wherein this operation is also referred to as water operation of action. In a following passivating operation, the cooling circuit is filled with a passivating agent in such a manner that during the filling of the cooling circuit with the passivating agent the water is simultaneously displaced out of the cooling circuit. In a following rinsing operation, the cooling circuit is rinsed with ion-free water again in such a manner that the ion-free water at least partially displaces the passivating agent out of the cooling circuit. During the rinsing operation, the entire passivating agent can thus be displaced out of the cooling circuit by the ion-free water or the passivating agent at least diluted with the ion-free water. This means that following the rinsing operation a liquid of water and/or passivating agent remains in the cooling circuit. In a subsequent coolant filling operation, the cooling circuit is filled with the coolant in such a manner that the coolant displaces the liquid of water and/or passivating agent out of the cooling circuit. Following this, the cooling circuit is sealed in such a manner that the cooling circuit is filled with the coolant.

During the water filling operation and during the water operation of action, the cooling circuit is cleaned on the inside and/or constituents, contaminations and the like removed. During the following passivating operation, the cooling circuit is passivated on the inside, i.e. a protective layer is applied in particular on the inside of the cooling circuit. With the following rinsing operation, the ion load of the passivating agent is displaced out of the cooling circuit or at least reduced. Thus, an initial electric conductivity of the coolant, in the following also referred to as original conductivity, is not increased or at least to a substantially reduced extent in the following coolant filling operation. The following sealing of the cooling circuit prevents fluids, in particular gases, entering the cooling circuit, which can lead to a corresponding increase of the original conductivity of the coolant.

Here, filling means preferentially the complete filling of the cooling circuit, i.e. comprising all components which can come into contact with coolant during the operation of the cooling circuit. Thus, during the respective filling, pumps, valves and the like are also filled besides tubular bodies, hoses and the like. The same advantageously applies to the rinsing operation during which the entire cooling circuit is rinsed with ion-free water.

Basically, the coolant can be any coolant provided it is suitable for use in a cooling circuit of a motor vehicle. The coolant is in particular a water-based coolant.

The rinsing operation preferably takes place in such a manner that the passivating agent is merely diluted. This means that the liquid contains water and passivating agent. Thus, the cooling circuit can be passivated in a simpler and more effective manner.

The passivating agent can generally be any provided that at least some components of the cooling circuit can be passivated with the same.

The passivating agent is in particular dicarboxylic acids, advantageously with aminic wetting agents and/or zirconium-based solutions. The dicarboxylic acid is for example a tartaric acid. The concentration of the dicarboxylic acids in the passivating agent advantageously amounts to between 1% and 10%. The zirconium solution advantageously has a concentration between 0.1% and 5% and the aminic wetting agents, which can be present for example as triethanolamine have a concentration in the passivating agent between 0.3% and 5%. Thus, the entire cooling circuit can be easily and effectively passivated on the inside.

Preferred are embodiments, in which the ion-free water is introduced into the cooling circuit with an increased temperature in at least one of the associated operations, i.e. during the water filling operation and/or during the rinsing operation. This results in that an efficiency of the treatment of the cooling circuit with the ion-free water is improved and increased. For this purpose, the ion-free water advantageously has a temperature of at least 80° C., advantageously of at least 90° C.

The ion-free water is advantageously distilled water and/or water having an electric conductivity of less than 5 microsiemens per centimetre (μS/cm). Thus, a particularly effective and reliable cleaning of the cooling circuit prior to the filling with the coolant is achieved.

It is to be understood that the water introduced into the cooling circuit as ion-free water can be ion-containing when drained out of the cooling circuit.

Preferably, the coolant has an original conductivity that amounts to less than 5 μS/cm.

Preferably, the introduction of the associated fluid and the displacement of the other fluid takes place in at least one of the operations, advantageously in the respective operation, by sucking the fluid to be introduced into the cooling circuit. This means in the case of the passivating operation for example that the passivating agent is sucked into the cooling circuit and at the same time the water of the water filling operation sucked out of the cooling circuit. The result of this is in particular that during the respective operation no foreign fluids, such as gases, in particular air can enter the cooling circuit and in particular, through depositions and chemical reactions with the components and/or fluids already present in the cooling circuit lead to an increase of the conductivity of the coolant subsequently introduced into the cooling circuit or the corresponding risk is at least reduced.

Particularly preferably, for sucking-in the respective fluid into the cooling circuit, an underpressure is generated downstream of the cooling circuit and the fluid to be introduced into the cooling circuit admitted into the cooling circuit on the upstream-side. This means that the filling, preferentially also the rinsing, takes place by way of the sucking out of the existing fluid and simultaneous sucking-in of the new fluid, i.e. of passivating agent or ion-free water or coolant. As a consequence, the entering of undesirable fluids and/or particles into the cooling circuit is prevented or at least reduced.

The water duration of action during the water operation of action can basically be for as long a period as desired. Here, water durations of action between 30 seconds and 15 minutes, in particular between 1 minute and 10 minutes prove to be advantageous and effective.

Advantageous are embodiments, in which following the passivating operation and prior to the coolant filling operation, the liquid of passivating agent and/or water is left in the cooling circuit during a passivating operation of action for a passivating duration of action, wherein the liquid preferably contains passivating agent. This leads to an effective passivation of the cooling circuit and a reduction of the consumption of passivating agent.

The passivating duration of action can be any. Embodiments, in which the passivating duration of action amounts to between 30 seconds and 15 minutes, in particular between 1 minute and 10 minutes, prove to be advantageous.

Advantageous are embodiments, in which the passivating agent during the passivating operation is introduced into the cooling circuit with an increased temperature. This means that during the passivating operation the cooling circuit is filled with passivating agent of increased temperature. This leads to an increase of the efficiency of the passivation and/or to a reduction of the consumption of passivating agent.

Here, embodiments in which the cooling circuit is filled with passivating agent having a temperature of at least 80° C., preferentially of at least 90° C. prove to be advantageous.

Advantageously, the coolant is introduced into the cooling circuit with a temperature that is lower than the increased temperature of the passivating agent and/or of the ion-free water. This results in that the cooling circuit is cooled when being filled with the coolant. Here it is preferred when in the coolant filling operation coolant with a temperature of under 80° C., in particular with normal temperature, is introduced into the cooling circuit.

Generally, coolant can be introduced into the cooling circuit during the coolant filling operation until the cooling circuit is filled with coolant for the first time.

It is preferable when during the filling operation coolant is introduced into the cooling circuit and coolant simultaneously drained out of the cooling circuit, i.e. the cooling circuit is at least partly rinsed with coolant. In the process, the electric conductivity of the coolant drained out of the cooling circuit is advantageously monitored and coolant introduced into the cooling circuit until the electric conductivity of the drained coolant is below a specified value, for example below five μS/cm. Thus, the coolant is likewise used for rinsing through the cooling circuit and/or ensured that at least predominantly coolant is present in the cooling circuit which has the specified electric conductivity. In this way, a subsequent increase of the original conductivity of the coolant during the operation of the cooling circuit in particular is prevented or at least reduced.

Advantageous are embodiments, in which in the cooling circuit prior to the water filling operation a vacuum is generated. Thus, by generating the vacuum a first cleaning of the cooling circuit of gases and/or particles takes place. In addition, an increased efficiency in the following water filling operation and/or a reduced consumption of ion-free water materialize. Accordingly it is preferred when during the water filling operation the ion-free water is filled into the evacuated cooling circuit.

The introduction of the ion-free water and/or of the passivating agent and/or of the coolant into the cooling circuit preferably takes place with the help of a suction pump, particularly preferably of a vacuum pump, which sucks the said fluids into the cooling circuit. It is advantageous, furthermore, when the draining of the water and/or of the passivating agent and/or of the liquid and/or of the coolant out of the cooling circuit in the respective associated operation likewise takes place by way of the suction pump, in particular vacuum pump. This results that the method according to the invention is carried out in a simple and cost-favourable manner and reduces the risk that other undesirable fluids enter the cooling circuit.

It is to be understood that besides the method according to the invention a system, with which the method can be realised, also belongs to the scope of this invention.

Besides the suction pump, the system advantageously comprises an inlet connection and an outlet connection which for filling the cooling circuit can each be fluidically connected to the cooling circuit in a releasable manner. Here, the inlet connection is connected to an upstream-side inlet of the cooling circuit and the drainage connection to a downstream-side outlet of the cooling circuit.

Preferably, the system comprises an associated tank for the fluid required during the respective operation. The system comprises in particular a tank for holding ion-free water, in the following also referred to as water tank. A coolant tank that is separate from the water tank for holding the coolant and a passivating agent tank that is separate from the coolant tank and from the water tank for holding the passivating agent. Furthermore, the system comprises a valve device between the inlet connection and the tanks which is configured in such a manner that it connect the respective tank individually and optionally with the inlet connection and thus the inlet of the cooling circuit. Furthermore, the system comprises a control device which is communicatingly connected to the valve device and the suction pump and configured for carrying out the method.

Advantageously, the system comprises a heating device with which the ion-free water and/or the passivating agent can be heated prior to admission into the cooling circuit. Accordingly, the heating device is preferably arranged between the inlet connection and the water tank or the passivating agent tank.

It is preferred, furthermore, when the coolant is conducted past the heating device. By way of this it is prevented in particular that the heating device increases the electric conductivity of the coolant while flowing through the heating device.

For this purpose, the system advantageously comprises a first feeding path upstream of the inlet connection and a second feeding path, wherein the first feeding path serves for feeding water and passivating agent to the inlet connection and thus to the cooling circuit and the second feeding path for the feeding of coolant to the inlet connection and thus to the cooling circuit. Here, the first feeding path leads through the heating device whereas the second feeding path runs outside the heating device, in particular past the heating device.

Embodiments, in which the system comprises a neutralisation device which serves for neutralising the fluid flowing out of the cooling circuit, in particular the water and/or the passivating agent and/or the liquid and/or the coolant. The neutralisation device is practically arranged downstream of the outlet connection. Preferably, the neutralisation device is additionally arranged downstream of the suction pump. Here, the neutralisation device is configured in such a manner that it neutralises the fluid flowing out of the cooling circuit. This means that the neutralisation device is configured in such a manner that it removes in particular ions from the fluid.

For this purpose, the neutralisation device can comprise mineral packing of calcium and/or magnesium carbonate and/or magnesium hydroxide through which the fluid originating from the cooling circuit flows. Thus, in particular the environmental footprint during the filling of the cooling circuit is improved.

The method and the system can each be employed for filling a cooling circuit of any motor vehicle. At least partly electrically driven motor vehicles are considered here, in which the cooling circuit temperature-controls, in particular cools components storing and/or conducting and/or generating electric current. Here, the cooling circuit can lead for example through at least one of the components, for example an electric energy store, in particular an accumulator, and/or a fuel cell or a fuel cell stack.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference numbers relate to same or similar or functionally same components.

It shows

Figure 2:
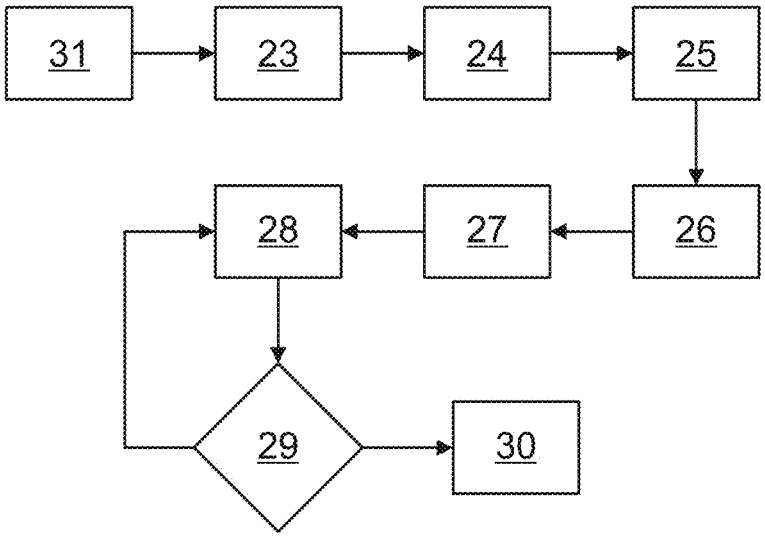

FIG. 1 a greatly simplified circuit diagram-like representation of a system for filling a cooling circuit with a coolant;

FIG. 2 a flow diagram for explaining a method for filling the cooling circuit with coolant.

With a system 1, as is exemplarily shown in FIG. 1, a cooling circuit 2 of a motor vehicle 3 which is not otherwise shown is filled with coolant 4. For this purpose, the system 1 comprises an inlet connection 5 for admitting a fluid into the cooling circuit 2, which is releasably connected to an inlet 6 of the cooling circuit 2. Furthermore, the system 1 comprises an outlet connection 7 via which fluid is drained out of the cooling circuit 2, wherein the outlet connection 7 is releasably connected to an outlet 8 of the cooling circuit 2. Furthermore, the system 1 comprises a suction pump 9, in particular a vacuum suction pump 10, which during the operation sucks fluid out of the inlet connection 5 in the direction of the outlet connection 7 and thus in the state connected to the cooling circuit 2, through the cooling circuit 2. Here, the suction pump 9 is arranged downstream of the outlet connection 7. Upstream of the inlet connection 5, the system 1 comprises a coolant tank 11 for holding the coolant 4, which in particular is a water-based coolant 4. In addition, the system 1 comprises a water tank 12 upstream of the inlet connection 5 for holding ion-free water 13 in particular distilled water 14, which preferably has an electric conductivity of less than 5 μS/cm. The coolant 4 held in the coolant tank 11 has an electric conductivity which in the following is also referred to as original electric conductivity. The original electric conductivity of the coolant 4 preferentially amounts to less than 5 μS/cm. Upstream of the inlet connection 5, the system 1 furthermore comprises a passivating agent tank 15 that is separate from the water tank 12 for holding a passivating agent 16, which can comprise dicarboxylic acids and/or aminic wetting agents and/or zirconium-containing solutions. The passivating agent 16 can comprise for example dicarboxylic acids, in particular tartaric acid, in a concentration between 1 and 10%, a zirconium solution in a concentration of 0.1 to 5% as well as aminic wetting agents, in particular triethanolamine, in a concentration between 0.3 and 5%. Furthermore, the system 1 comprises a valve device 17 which is arranged between the inlet connection 5 and the tanks 11, 12, 15 and configured in such a manner that it can individually connect the respective tank 11, 12, 15 with the inlet connection 5 and thus the cooling circuit 3, so that from the respective tank 11, 12, 15 ion-free water 13, passivating agent 16 as well as coolant 4 can be individually sucked into the cooling circuit 3. In the shown exemplary embodiment, the system 1 additionally comprises a heating device 18 with which the ion-free water 13 flowing out of the water tank 12 in the direction of the inlet connection 5 and the passivating agent 16 flowing out of the passivating agent tank 15 in the direction of the inlet connection 5 can be heated. Here, the system 1 can comprise a first feeding path 19, which leads through the heating device 18 and connects the water tank 12 and the passivating agent tank 15 via the valve device 17 with the inlet connection 5. In addition, the system 1 can comprise a second feeding path 20 which runs outside the heating device 18 and connects the coolant tank 11 via the valve device 17 with the inlet connection 5. Furthermore, the system 1 can comprise a measuring device 21 with which the electric conductivity of the fluid flowing out of the cooling circuit 2 can be determined, wherein the measuring device 21 in the shown example is arranged between the suction pump 9 and the outlet connection 7. Furthermore, the system 1 comprises a control device 22 which, as indicated with dashed lines, is communicatingly connected to the valve device 17, the suction pump 9 and the measuring device 21 and the heating device 18 and configured for operating the system 1 for filling the cooling circuit 2 with coolant 4.

According to the flow diagram shown in FIG. 2, the cooling circuit 2 can be filled with coolant 4. Here, ion-free water 13 out of the water tank 2 is sucked into the circuit 2 in a water filling operation 23, so that the circuit 2 is completely filled with the water 13. Preferentially, the ion-free water 13 when introduced into the cooling circuit 2, preferentially has, with the help of the heating device 18, a temperature of at least 80° C., preferentially of at least 90° C. In a following water operation of action 24, the water, with which the cooling circuit 2 is filled, is left in the cooling circuit 2 for a specified duration of action, for example between 1 minute and 10 minutes. During the water operation of action 24, the water 13 thus interacts with the interior of the cooling circuit 2 in order to free the interior of the cooling circuit 2 of dirt, contaminations and the like. At the same time, ions and/or salts from the interior of the cooling circuit 2 are absorbed in the water. In a following passivating operation 25, the water 13, which can now be ion-containing, is sucked out of the cooling circuit 2 and passivating agent 16 additionally sucked into the cooling circuit 2, so that the passivating agent 16 displaces the water 13 out of the cooling circuit 2 and the cooling circuit 2 is completely filled with the passivating agent 16. Preferably, when being introduced into the cooling circuit 2, the passivating agent 16, has, with the help of the heating device 18, an increased temperature of at least 80° C., preferentially of at least 90° C. In a following rinsing operation 26, ion-free water 13, preferentially with a temperature of at least 80° C., preferably of at least 90° C., is introduced into the cooling circuit 2 in such a manner that the passivating agent 16 present in the cooling circuit 2 is preferentially diluted. Accordingly, passivating agent 16 is simultaneously sucked out of the cooling circuit during the rinsing operation 26, wherein the inflowing ion-free water 13 partly displaces the passivating agent 16 already present in the cooling circuit 2. Following the rinsing operation 26, the cooling circuit 2 is preferably filled with a liquid of passivating agent 16 and water 13. Preferably, following the rinsing operation 26, the liquid present in the cooling circuit 2 is left, in a passivating operation of action 27, in the cooling circuit 2 for a passivating duration of action, wherein the passivating duration of action can amount to between 1 minute and 10 minutes. In a following coolant filling operation 28, coolant 4 is sucked, preferentially at ambient or normal temperature, into the cooling circuit 2 and simultaneously the liquid present in the circuit 2 sucked out in such a manner that the coolant 4 sucked into the cooling circuit 2 displaces the liquid present in the cooling circuit 2.

Preferably, the coolant operation 28 is monitored in a monitoring operation 29. During the monitoring operation 29, the electric conductivity of the coolant 4 flowing out of the cooling circuit 2 is monitored. This means that during the monitoring operation 29 after the complete filling of the cooling circuit 2 with coolant 4, coolant 4 continues to be sucked into the cooling circuit 2 and the coolant 4 sucked out of the cooling circuit 2 monitored with the measuring device 21 with respect to the electric conductivity. When the coolant 4 sucked out of the cooling circuit 2 has an electric conductivity that is above a specified limit of for example 5 μS/cm, coolant 4 continues to be sucked into the cooling circuit 2. When the determined electric conductivity of the coolant 4 sucked out of the cooling circuit 2 by contrast is below the specified electric conductivity, in particular below 5 μS/cm, the cooling circuit 2 is fluidically sealed in a sealing operation 30, so that the cooling circuit 2 is filled with coolant 4 and no longer exchanges any fluid, in particular so that the inlet 6 and the outlet 8 of the cooling circuit 2 are fluidically closed.

As is evident from FIG. 2, an underpressure, in particular a vacuum, can be generated prior to the water filling operation 23 during an evacuating operation 31 in the cooling circuit 2, wherein for this purpose the suction pump 9 is again employed. This means that prior to introducing the ion-free water 13 into the cooling circuit 2, fluid, in particular air, is sucked out of the cooling circuit 2 during the water filling operation 23. Preferably, ion-free water 13 is sucked during the water filling operation 23 into the cooling circuit 2 subjected to the under pressure, in particular the vacuum.

As is evident from FIG. 1 furthermore can comprise a neutralisation device 32 with which the fluid sucked out of the cooling circuit 2, i.e. the water and/or the passivating agent and/or the liquid and/or the coolant is neutralised. During the neutralisation, the ion-concentration of the fluid in particular is at least reduced. In the exemplary embodiment shown in FIG. 1, the neutralisation device 32 is arranged downstream of the suction pump 9. Here, the neutralisation device 32 can comprise a packing 33 which comprises in particular calcium and/or magnesium carbonate and/or magnesium hydroxide.

The invention claimed is:

1. A method for filling a cooling circuit of a motor vehicle with a coolant, the method comprising:

in a water filling operation, filling the cooling circuit with ion-free water;

in a water operation of action, leaving the ion-free water in the cooling circuit for a water duration of action;

in a passivating operation, displacing the ion-free water out of the cooling circuit via filling the cooling circuit with a passivating agent;

in a rinsing operation, rinsing the cooling circuit with ion-free water such that the ion-free water at least dilutes the passivating agent in the cooling circuit and a liquid including at least one of the ion-free water and the passivating agent remains in the cooling circuit;

in a coolant filling operation, displacing the liquid out of the cooling circuit via filling the cooling circuit with the coolant;

in a sealing operation, fluidically sealing the cooling circuit filled with the coolant towards an outside.

2. The method according to claim 1, wherein, at least one of the water filling operation and the rinsing operation, include introducing the ion-free water with a temperature of at least 80° C. into the cooling circuit.

3. The method according to claim 1, wherein the ion-free water in at least one of the water filling operation and the rinsing operation is distilled water.

4. The method according to claim 1, wherein the ion-free water in at least one of the water filling operation and the rinsing operation has an electric conductivity of 5 μS/cm or less.

5. The method according to claim 1, wherein at least one of the water filling operation, the passivating operation, the rinsing operation, and the coolant filling operations includes sucking one of the ion-free water, the passivating agent, and the coolant into the cooling circuit via generating an under pressure on a downstream side of the cooling circuit.

6. The method according to claim 1, wherein, during the water operation of action, the water duration of action is 30 seconds to 15 minutes.

7. The method according to claim 1, further comprising, in a passivating operation of action performed after the passivating operation and prior to the coolant filling operation, leaving the liquid in the cooling circuit for a passivating duration of action.

8. The method according to claim 7, wherein, during the passivating operation of action, the passivating duration of action is 30 seconds to 15 minutes.

9. The method according to claim 1, wherein the passivating operation includes introducing the passivating agent with a temperature of at least 80° C. into the cooling circuit.

10. The method according to claim 1, wherein the coolant filling operation includes introducing the coolant with a temperature of under 80° C. into the cooling circuit.

11. The method according to claim 1, wherein the coolant filling operation includes introducing the coolant into the cooling circuit and draining the coolant out of the cooling circuit until the drained coolant has an electric conductivity that is below a specified limit value.

12. The method according to claim 1, further comprising generating a vacuum in the cooling circuit prior to the water filling operation, and wherein the water filling operation includes filling the cooling circuit with the ion-free water when the cooling circuit is evacuated.

13. A system for filling a cooling circuit of a motor vehicle with coolant, the system comprising:

an inlet connection for admitting fluid into the cooling circuit, the inlet connection configured to releasably connect to an inlet of the cooling circuit when filling the cooling circuit;

an outlet connection for draining fluids out of the cooling circuit, the outlet connection configured to releasably connect to an outlet of the cooling circuit when filling the cooling circuit;

a suction pump arranged downstream of the outlet connection, the suction pump configured to, during operation, suck fluid through the cooling circuit via sucking fluid through the inlet connection and the outlet connection;

a water tank arranged upstream of the inlet connection and configured to hold ion-free water;

a passivating agent tank arranged upstream of the inlet connection and configured to hold passivating agent;

a coolant tank arranged upstream of the inlet connection and configured to hold coolant;

a valve device arranged between the inlet connection and the water tank, the passivating agent tank, and the coolant tank, the valve device configured to selectively and individually fluidically connect and disconnect the water tank, the passivating agent tank, and the coolant tank to/from the inlet connection; and a control device communicatingly connected to the valve device and the suction pump, the control device configured to operate the system in accordance with the method of claim 1 to fill the cooling circuit when the inlet connection and the outlet connection are connected to the cooling circuit.

14. The system according to claim 13, further comprising a heater through which fluid is flowable, wherein:

the heater is arranged between the inlet connection and at least one of the water tank, the passivating agent tank, and the coolant tank; and the heater is configured to, during operation, heat fluid flowing therethrough.

15. The system according to claim 14, further comprising:

a first feeding path disposed upstream of the inlet connection, the first feeding path structured and arranged to feed at least one of the ion-free water and the passivating agent to the inlet connection through the heater; and a second feeding path disposed upstream of the inlet connection, the second feeding path structured and arranged to feed the coolant to the inlet connection outside of the heater.

16. The system according to claim 13, further comprising a neutralisation device disposed downstream of the outlet connection, the neutralization device configured to neutralise fluid flowing out of the cooling circuit.

17. The method according to claim 1, wherein, at least one of the water filling operation and the rinsing operation, include introducing the ion-free water with a temperature of at least 90° C. into the cooling circuit.

18. The method according to claim 1, wherein, during the water operation of action, the water duration of action is 1 minute to 10 minutes.

19. The method according to claim 1, wherein the passivating operation includes introducing the passivating agent with a temperature of at least 90° C. into the cooling circuit.

20. The method according to claim 1, wherein the coolant filling operation includes introducing the coolant into the cooling circuit and draining the coolant from the cooling circuit until the drained coolant has an electric conductivity that is 5 μS/cm or less.

* * * * *